US006786067B2

(12) United States Patent
Stupecky

(10) Patent No.: US 6,786,067 B2
(45) Date of Patent: Sep. 7, 2004

(54) DEVICE FOR THE SLICKING, STRETCHING AND DRYING OF LEATHER OR SIMILAR FLAT MATERIALS SUCH AS HIDES, SKINS AND THE LIKE

(76) Inventor: Bohumil Stupecky, Zum Nussbaum 6, Mertesdorf (DE), D-54318

( * ) Notice: Subject to any disclaimer, the term of this patent is extended or adjusted under 35 U.S.C. 154(b) by 0 days.

(21) Appl. No.: 10/633,988

(22) Filed: Aug. 4, 2003

(65) Prior Publication Data

US 2004/0069022 A1 Apr. 15, 2004

Related U.S. Application Data

(62) Division of application No. 09/719,760, filed as application No. PCT/DE99/01636 on Jun. 2, 1999, now Pat. No. 6,615, 621.

(51) Int. Cl.[7] ..... C14B 1/26
(52) U.S. Cl. ..... 69/19.1; 69/19
(58) Field of Search ..... 69/19.1, 29, 32, 69/48, 19, 19.2; 34/266; 26/51; 38/12, 17, 18, 102

(56) References Cited

U.S. PATENT DOCUMENTS 4,202,190 A * 5/1980 Viljanmaa ..... 69/19.3
4,335,594 A * 6/1982 Viljanmaa ..... 69/19.3
4,438,570 A * 3/1984 Dokoupil ..... 34/266
4,487,041 A * 12/1984 duBourg ..... 69/1
5,291,759 A * 3/1994 Dokoupil ..... 69/19.1

FOREIGN PATENT DOCUMENTS

DE 19826181 * 12/1999 ..... C14B/1/26
FR 2602795 * 8/1986 ..... C14B/1/40

* cited by examiner

*Primary Examiner*—Gary L. Welch
(74) *Attorney, Agent, or Firm*—Smith, Gambrell & Russell, LLP

(57) ABSTRACT

The invention relates to a device for fleshing, stretching and drying leather or similar flat materials such as skins and furs. The device consists of movable lamellae which can be extended from the center outwards and which under vacuum and the cooperation of a pressing device provides a smooth, gliding heatable contact surface on which the stretched and fixed piece of leather is simultaneously dried thereby minimizing any frictional forces encountered when stretching leather in a vacuum. Moisture is evacuated through channels, raised areas, perforations in one of the lamellae thereby improving the stretching effect and uniformity of the stretched leather across its entire surface without wrinkling.

11 Claims, 2 Drawing Sheets

DEVICE FOR THE SLICKING, STRETCHING AND DRYING OF LEATHER OR SIMILAR FLAT MATERIALS SUCH AS HIDES, SKINS AND THE LIKE

CROSS-RELATED APPLICATION

This application is a divisional application of U.S. patent application Ser. No. 09/719,760, filed Mar. 9, 2001 now U.S. Pat. No. 6,615,621, which is a 35 U.S.C. §371 application of International PCT Application No. PCT/DE99/01636; filed Jun. 2, 1999.

The invention pertains to a device for the slicking, stretching and drying of leather or similar flat materials such as hides, skins and the like.

It is known from DE 30.10.003 how pieces of leather, pressed together by a vacuum in the interstice between two elastically extensible foils, can be stretched by extending these foils simultaneously.

A device, representing the next state of the art, is known from DE 38.33.068, in which pieces of leather are stretched in the interstice between a low friction support surface and an elastically extensible membrane under vacuum. As opposed to the device according to DE 30.10.003, the employment of a rigid support surface of material with high thermal conductivity permits use as a combined stretching and drying machine, the moisture evaporating from the leather being drained through a relief structure on the membrane, which is connected with a suction device.

The primary disadvantage of this device is that, in spite of the low friction support surface, the contact pressure forces on the leather act against the stretching force. The resistance (friction) thus caused prevents optimum pick-up of the leather and uniform stretching of its whole area, limiting the dimensional increase which can be achieved. In the process, there is great strain on the elastic membrane. Its resulting limited service life leads to increased running costs for the machine. Furthermore, this device is only suitable for the treatment of skins with a low water content (approx. 25%) and is unsuitable for very wet leather.

From the French patent application 2602795, a device is known which conforms with the general concept of the invention.

Figure 1:
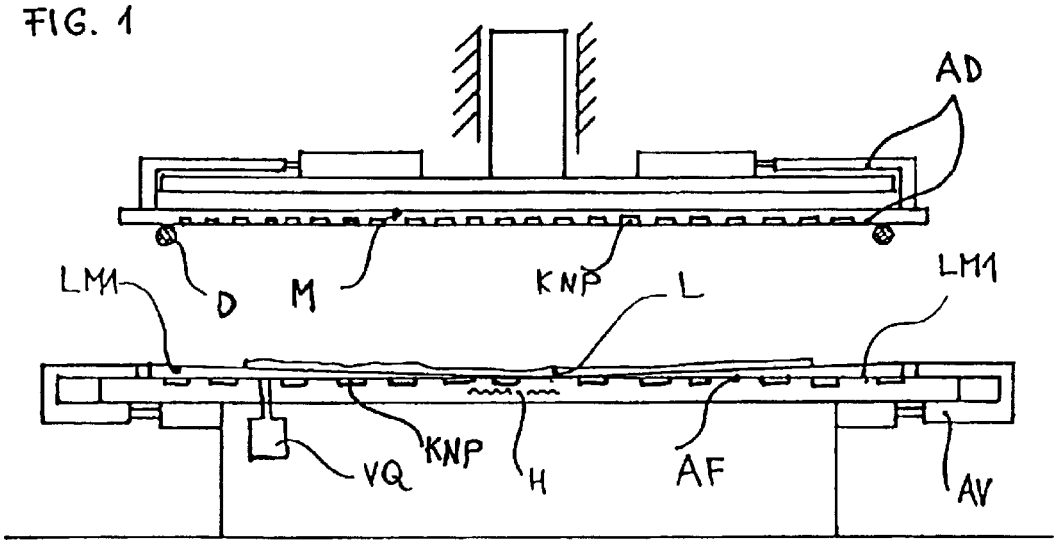
Figure 3:
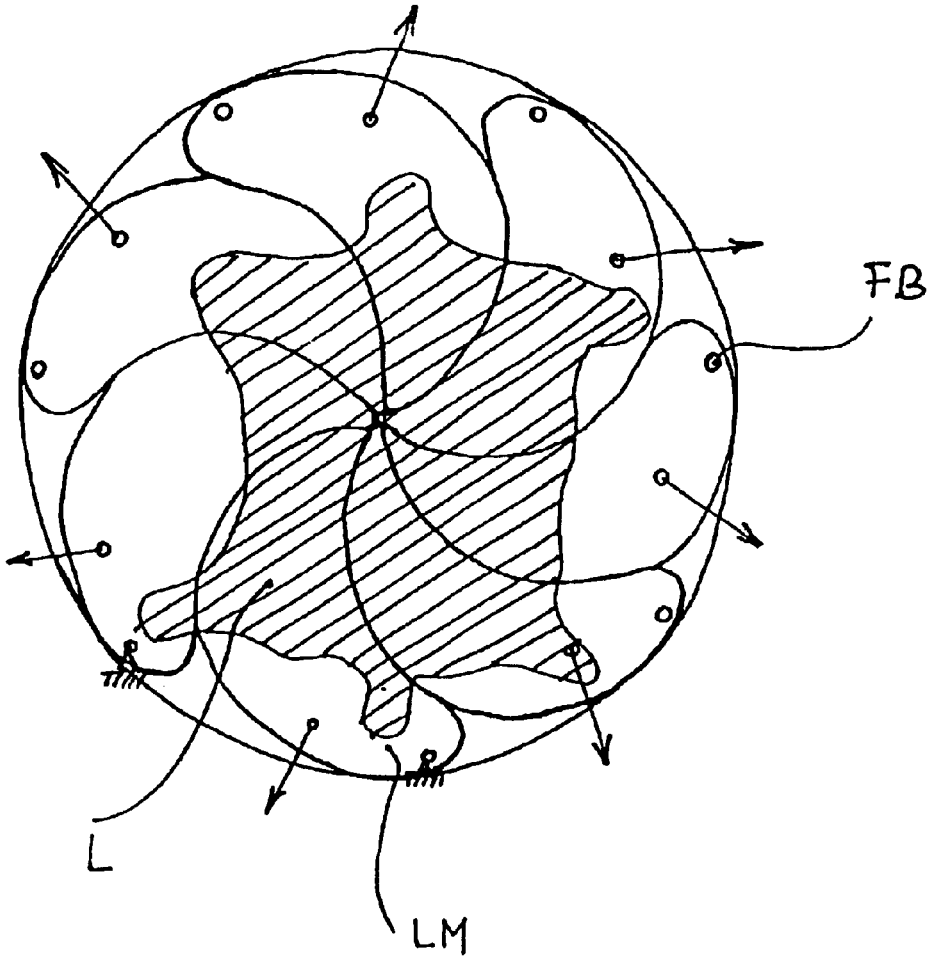

This shows triangular lamellae which can be radially extended outwards from their closed position as shown in FIG. 1 to the position shown in FIG. 3, thus stretching the hide. The essential, differentiating characteristic of the device according to this patent application is that the lamellae swing outwards around a fixed point as in an iris aperture. As a result of this special movement of the lamellae, no spaces occur between the lamellae during the movement, but a central widening opening is formed, so that the already stretched sections of the hide in this area can already be pressed flat and dried. Furthermore, because of the special form of the lamellae, the stretched hide is held fast over its entire circumference at the limit position of the lamellae.

In contrast to this, in accordance with the French patent application, as the lamellae move outwards, spaces occur between them in which the hide is no longer held. When the triangular lamellae are deployed outwards, the hide is only held by the tips of the lamellae, thus with a relatively small surface area, while large parts of the circumference of the hide are no longer held by the lamellae.

Vacuum drier units are also known which can also dry very wet leather. The slicking out of surplus water here is carried out manually. However, here the leather is only dried, not simultaneously stretched; in fact, it actually shrinks.

The function of the invention is the creation of a device which eliminates the high friction forces during stretching of the leather under vacuum, in that the leather support surface is formed of elements which carry with them the whole surface of the leather and the contact pressure device without friction resistance to the support surface, resulting in optimum area enlargement, and is also able to stretch and dry very wet leather simultaneoulsy and, if necessary, to slick it out first.

The problem is solved in accordance with this invention in that, over a smooth, low friction, support surface, consisting of thermally conductive material and heated by hot water, oil or another medium, movable lamellae are fitted, which are connected with a drive mechanism to deploy them in a circle outwards from the centre around a fixed point. These lamellae form the actual stretching mechanism, while the primary function of the stacked contact pressure device, consisting of a sheet of extensible material with channels, nubs, perforations and the like for drainage of the moisture from the leather, is fixation. The contact pressure device may also consist of a rigid, inextensible plate, the surface of which is provided with channels, perforations and the like for drainage of moisture from the leather. On this, a second mirror-image lamella system is mounted, so that the leather is stretched between the two outwards deployable lamella systems and is fixed by the rigid contact pressure plate.

In the following, versions of the device constituting the invention are explained with the help of drawings.

These show:

FIG. 1—a complete side view of the device

Figure 2:
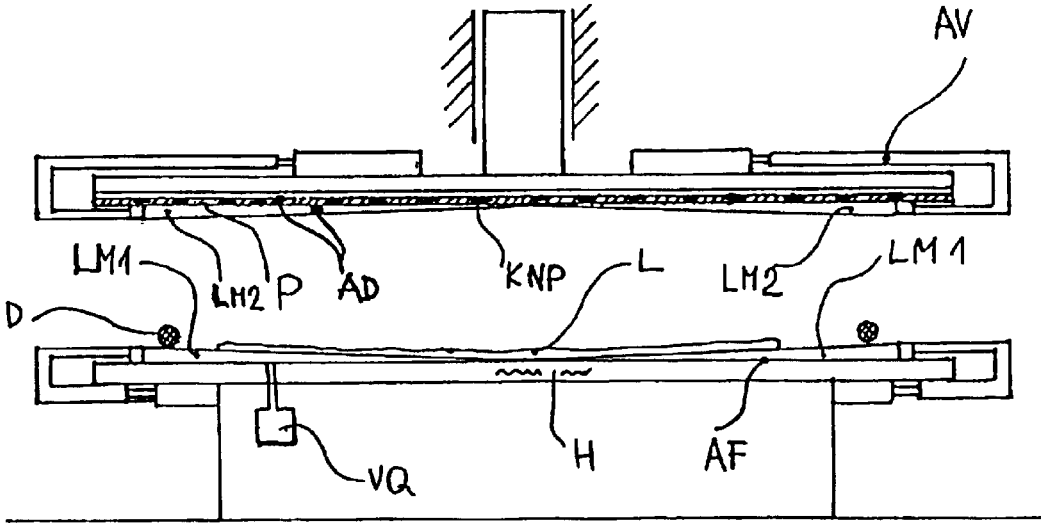

FIG. 2—a complete side view of the device

FIG. 3—a plan view of the lamella system loaded with a leather piece, showing the direction. of deployment of the lamellae outwards from the centre The device illustrated in FIG. 1 works with a lamella system (LM1) mounted on the support surface (AF), above which a contact pressure and stretching device consisting of a stretchable membrane (M) is mounted. e leather piece (L) is laid on the lamellae (LM1) of the support surface (AF). By means of a vertical movement, the two parts are moved together and the space between them is sealed a gasket (D) at the edge of the stretchable membrane (M) or the support surface (AF). The interstitial space, which is connected to a vacuum source (VQ), is evacuated. At the same time, the lamellae (LM1) are deployed, for example through a circular motion around a fixed pin (FB as shown in FIG. 3 by means of a drive device (AV), which may be mechanical, hydraulic or pneumatic, and carry with them the leather piece (L) laid on them.

In this way, the surplus water is slicked out, creases are smoothed and the surface is uniformly stretched.Channels, rubs, perforations are designated by KNP in FIGS. 1 and 2. The contact pressure device (AD) formed by the stretchable membrane (M) partly follows the movement of the lamellae, but is nevertheless moved by its own stretching mechanism. As the lamellae (LM1) deploy, they expose a smooth support surface (AF) of high grade metal, heated by a heater (H). The stretched membrane (M) now continuously fixes the stretched leather piece (L) on the support surface (AF), simultaneously drying it through the heating effect. The moisture generated is drained through channels, nubbed surfaces, perforation and the like, either in the metal plate of the support surface (AF) or in the membrane (M). On completion of the stretching and drying process, the vacuum is released.

The device illustrated in FIG. 2 works according to the same principle; the contact pressure device (AD), however, consists of a rigid, inextensible plate (P), upon which a second mirror-image lamella system (LM2) is mounted. After the build-up of the vacuum, the leather piece (L) is stretched by the simultaneous deployment of the two lamella systems (LM1, LM2), the heated support surface is exposed and the rigid, inextensible plate (P) fixes the leather (L).

FIG. 3 shows a design example of a lamella system LM, indicating the circular motion of the lamellae around a fixed point.

What is claimed is:

1. A device for the dewatering, stretching and drying of leather, similar flat materials and pieces thereof, having an interstice, sealed by a gasket and connected to a vacuum source for the leather piece and consisting of a support surface, above which lamellae are mounted with a drive mechanism to deploy said lamella outwards from the centre, and a contact pressure device consisting of a second lamella system fitted to a rigid, inextensible plate, connected to a stretching mechanism and mounted as a mirror image of the lower lamella system, whereby the lamellae can be deployed outwards by a circular movement around a fixed pin.

2. The device according to claim 1 wherein the support surface is smooth with low friction, consists of a material with high thermal conductivity and is heated by thermal energy in the form of hot water, oil or another medium.

3. The device according to claim 2 wherein the support surface has channels or perforations to drain the moisture from the leather.

4. The device according to claim 1 wherein the support surface has channels or perforations to drain the moisture from the leather.

5. The device according to claim 1 wherein the rigid, inextensible plate possesses channels, nubs, perforations and the like for the drainage of moisture from the leather.

6. The device according to claim 1 wherein the moveable lamellae present a sliding surface to the support surface and a surface able to move with the leather piece laid on it.

7. The device according to claim 1 wherein the support surface is smooth with low friction, consists of a material with high thermal conductivity and is heated by thermal energy in the form of hot water, oil or another medium.

8. The device according to claim 7 wherein the support surface has channels or perforations to drain the moisture from the leather.

9. The device according to claim 1 wherein the support surface has channels or perforations to drain the moisture from the leather.

10. The device according to claim 1 wherein the moveable lamellae present a sliding surface to the support surface and a surface able to move with the leather piece laid on it.

11. The device according to claim 1 wherein the drive mechanism for the deployment of the lamellae systems is of mechanical, hydraulic or pneumatic design.

* * * * *